US010256003B2

(12) United States Patent
Shirozu

(10) Patent No.: US 10,256,003 B2
(45) Date of Patent: Apr. 9, 2019

(54) BLIND-VENTED ELECTRODE

(71) Applicant: PLANSEE JAPAN LTD, Tokyo (JP)

(72) Inventor: Noboru Shirozu, Fukuoka (JP)

(73) Assignee: Plansee Japan Ltd., Tokyo (JP)

( * ) Notice: Subject to any disclaimer, the term of this patent is extended or adjusted under 35 U.S.C. 154(b) by 4 days.

(21) Appl. No.: 15/420,611

(22) Filed: Jan. 31, 2017

(65) Prior Publication Data

US 2018/0218800 A1 Aug. 2, 2018

(51) Int. Cl.
*G21K 1/087* (2006.01)
*H01J 49/22* (2006.01)
*H01J 27/02* (2006.01)

(52) U.S. Cl.
CPC ..... *G21K 1/087* (2013.01); *H01J 27/024* (2013.01); *H01J 2201/02* (2013.01)

(58) Field of Classification Search
CPC ..... H01J 1/00; H01J 1/02; H01J 1/46; H01J 1/88; H01J 9/02; G21K 1/00; G21K 2201/00
USPC ..... 250/396 R, 397, 396 ML
See application file for complete search history.

(56) References Cited

U.S. PATENT DOCUMENTS 5,956,562 A * 9/1999 Lo ..... C01B 13/11 422/186.07
8,153,993 B2 4/2012 Goldberg et al.
8,368,309 B2 2/2013 Horsky et al.
8,573,153 B2 11/2013 Fischer et al.
9,412,555 B2 8/2016 Augustino et al.
9,520,276 B2 12/2016 Takahashi et al.
2007/0187229 A1* 8/2007 Aksenov ..... H01J 37/32055 204/192.38
2014/0084396 A1* 3/2014 Jenkins ..... B81B 3/0021 257/419
2014/0102640 A1 4/2014 Yokogawa et al.

FOREIGN PATENT DOCUMENTS

JP 2007005491 A 1/2007
JP 2010521765 A 6/2010
JP 2012043796 A 3/2012
JP 2013110277 A 6/2013
JP 2014053319 A 3/2014
JP 2014082354 A 5/2014
JP 2016219820 A 12/2016

OTHER PUBLICATIONS

"Ion implantation: Ideal extraction assembly for VIISta HCP, HCS, Trident, and NexGen", Plansee High Performance Materials, Feb. 12, 2014.

* cited by examiner

*Primary Examiner* — Nicole M Ippolito
(74) *Attorney, Agent, or Firm* — Laurence A. Greenberg; Werner H. Stemer; Ralph E. Locher

(57) ABSTRACT

A vented electrode that provides a directional stop to prevent energetic particles and secondaries (i.e., secondary electrons, charged particles, photons) generated in the vent channel from reaching into a gap outside of the electrode plate. For example, ventilation is added to at least one electrode, via vented inserts, wherein the vents do not provide a direct line of sight from at least one side of the electrode plate to the other.

19 Claims, 6 Drawing Sheets

BLIND-VENTED ELECTRODE

BACKGROUND OF THE INVENTION

Field of the Invention

The invention relates to electrode plates that reduce high voltage glitch rates in accelerators by improving pumping, in particular, by adding blind vent holes in the electrode plates.

Description of the Related Art

In an accelerator system, biased electrodes are used for extraction of ions into a beam line. The biased electrodes in an accelerator are vulnerable to electrical breakdown ("glitch"). Similarly, plasma processing tools are known that utilize plasma electrodes vulnerable to glitches. The glitch rate of is related to: The material and surface condition of the electrodes; Gas pressure in the electrode gap; Secondary electrons and energetic photons generated at a negative electrode by impact of energetic ions or photons (i.e., x-rays); and Secondary ion and energetic photons generated at a positive electrode by the impact of energetic electrons or photons.

Previously, aperture electrode plates have frequently been made of tungsten, which stops x-rays. For example, FIG. 1 shows a suppression grid assembly 10 and a ground grid assembly 20 in accordance with the prior art. Suppression grid assembly 10 has a solid stainless steel plate 12, on which a tungsten plate 14 and one or more tungsten apertures 16 (two, in the illustrated example) are mounted. The ground grid assembly 20 includes solid stainless steel plates 22, on which an aperture plate 24 is mounted. In prior art, tungsten is preferred for parts of the grid assembly that are subject to strike by stray beam, and/or energetic secondary particles and photons.

However, the use of tungsten electrode plates and apertures 14, 16 contributes to metal contamination of the ion implantation processes. Additionally, the replacement of tungsten parts with graphite parts causes a significant increase in glitch rate of the extraction system. This is believed to be due to x-rays from the ion source or source plate passing through the graphite part of the suppressor grid assembly 14, 16 and creating secondary ions at the ground grid assembly 20 (which is positively biased with respect to the suppressor plate). Secondary ions from the ground grid assembly 20 are then accelerated across the suppression gap, into the more negative suppressor plate 12. Secondary x-rays, generated by ground ion impact on the suppressor grid assembly 10, can also pass through the graphite parts of the suppressor grid assembly 10 and generate secondary ions on the source grid, which can also be accelerated across the extraction gap into the suppressor grid assembly 10. It should be noted that stopping energetic photons (or, x-rays) depends on both the photon energy and the stopping material. For example, x-rays generated by a 30 kV extraction set are easily stopped by tungsten, but most pass through graphite electrodes. On the other hand, 5 keV x-rays are mostly stopped by 10 mm of graphite. For some applications, process compatibility of graphite, conducting silicon, or other light conductors may outweigh the disadvantage of poor x-ray stopping compared to tungsten or other heavy metals. Graphite is used in the present application as a representative example of a lighter, process compatible conductor useful in making electrodes. What is needed is a way to provide a significant reduction in glitch rate for electrodes when using lighter conductors.

Further, gas in the gap between electrodes contributes to the glitch rate of those electrodes. So, venting electrodes with channels can improve pumping, reduce gas pressure, and reduce glitch rate. Referring now to FIGS. 2 and 2A, vented, tungsten suppression electrodes 30 are commercially available. In particular, a graphite plate 32 including angled, line-of-sight venting slots 34 therethrough, has been made including a tungsten electrode aperture 36. However, this commercially available vented plate 30 design allows some secondary electrons, generated by ion or x-ray impact in the vent channels 34, to drift and be accelerated in either the suppression gap 60 or the extraction gap 50. Impact of these electrons on one of the positive electrodes can then contribute to a breakdown cascade and lead to a glitch. More particularly, the impact of x-rays or energetic through particles can generate ions that would be accelerated into the suppressor plate, which in turn can generate electrons that strike the source or ground electrodes. This also can contribute to the electrode glitch rate.

U.S. Pat. No. 8,153,993 to Goldberg et al., (the "'993 patent") discloses a front plate for an ion source which includes a slot penetrating through the front plate from obverse side to reverse side at a slant, to occlude line of sight into the ion source when viewed from in front, yet provides an expansion gap. The '993 patent discloses that the slot may be formed at a constant slant through the front plate or the slant may vary as the slit extends through the front plate and/or the slot may be kinked to form a dog-leg, for example. See, for example, col. 2 of the '993 patent, lines 47-50 and col. 5 of the '993 patent, lines 9-14. However, the slot of the '993 patent is formed to provide an expansion gap for the plate, but is specifically intended to minimize venting of gas from one side of the plate to the other. Rather, the '993 patent discloses that, as a result of the slanted slot, the tendency for ions and gas to escape from the ion source through the slot is much reduced. See, for example, col. 2 of the '993 patent, lines 20-21 and col. 4 of the '993 patent, lines 65-67 (i.e., " . . . ion loss and gas loss from the arc chamber 16 through the slit 80 is minimized").

In the case of positive ion beams, what is needed is a vented electrode or grid (the two terms being used interchangeably, herein), such as a suppression grid, that permits venting, while reducing metal contamination and providing a ground direction stop for energetic particles and photons created by impact of energetic particles in a vent channel. What is additionally needed is a vented grid that adds a directional stop to prevent secondary particles and photons that are created in the vent channel from reaching the extraction gap. What is further needed is a vented grid that creates a "two-way" (i.e., from either side of the vented plate), double line of sight stop for energetic particles and secondaries created by the impact of energetic particles in the vent channels.

BRIEF SUMMARY OF THE INVENTION

It is accordingly an object of the invention to provide a vented electrode that provides a ground direction stop for energetic particles and secondaries (i.e., secondary electrons, charged particles, photons) generated in a vent channel by ions or x-rays from the source gap. In another embodiment, a vented electrode is provided that adds a directional stop to prevent energetic particles and secondaries (i.e., secondary electrons, charged particles, photons) generated in the vent channel by ground gap ions or x-rays from reaching the source gap. In one particular embodiment of the invention, ventilation is added to at least one of the suppression and ground grid via blind-vented inserts, wherein the vents have two-way stops, and thus, do not have any direct line of sight from the suppression grid to the ground grid and vice versa, mounted into holes or slots in the suppression or ground plates, thereby improving vacuum levels in the surrounding areas. In another embodiment, the vented plates can be fabricated from a preferred conducting material, such as graphite, to replace tungsten with a more process compatible material.

Although the invention is illustrated and described herein as embodied in a blind-vented electrode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 3:
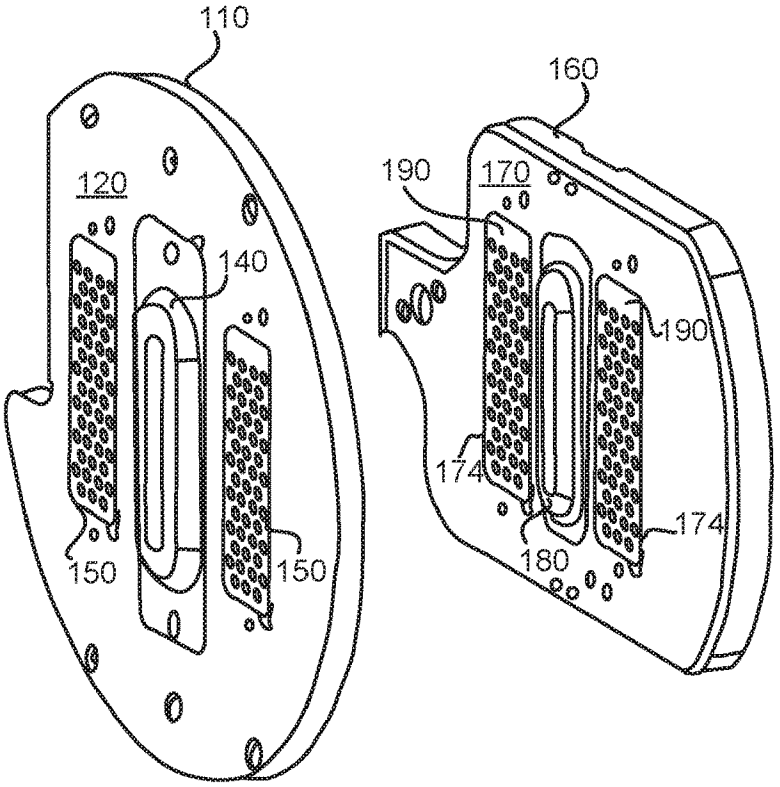
FIG. 3 is a simplified view of the grids in an extraction assembly of an ion implanter, the suppression grid and ground grid, in accordance with one particular embodiment of the present invention.
Figure 4:
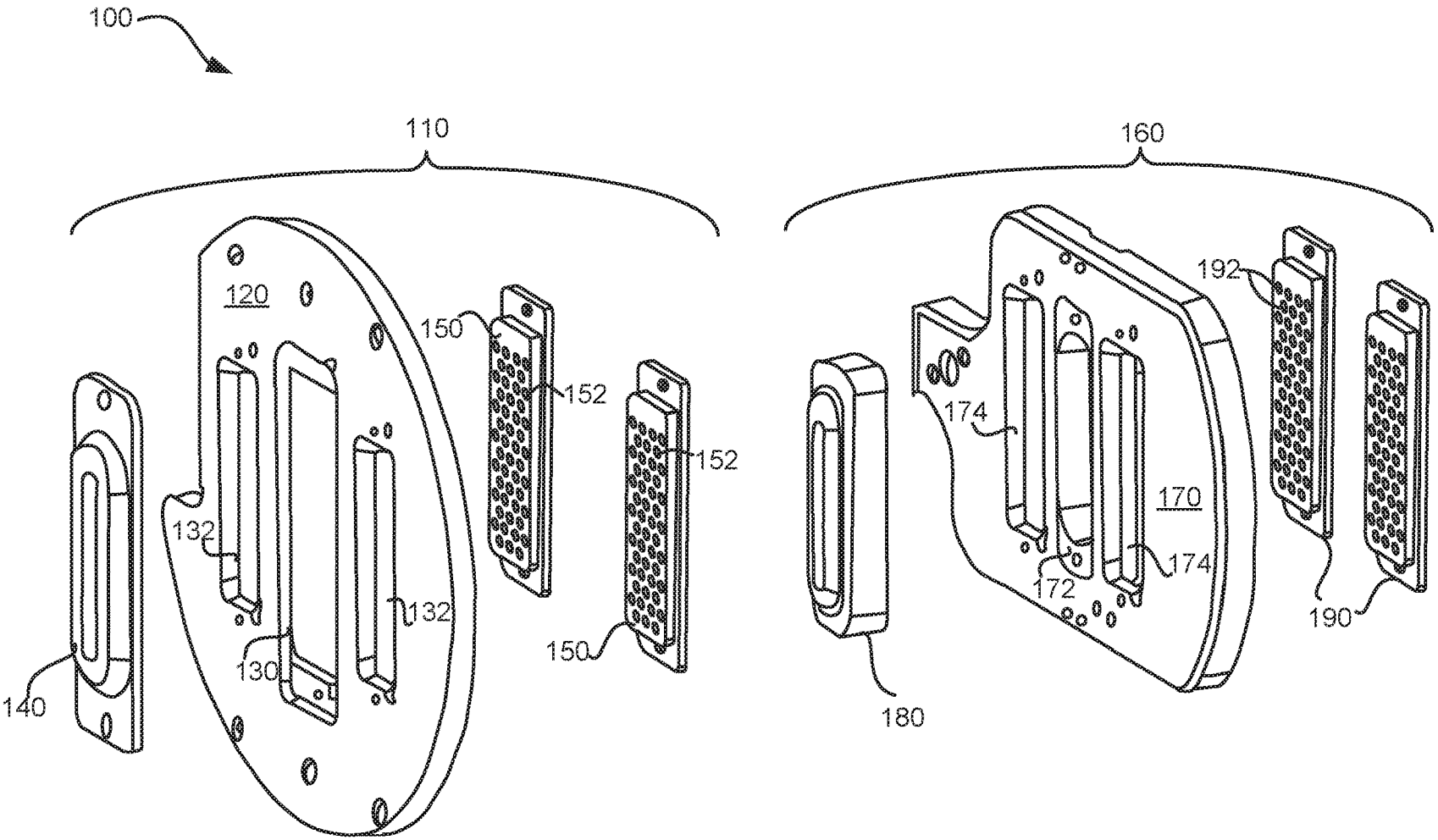
FIG. 4 is a simplified, exploded view of a suppression grid and ground grid of an ion implanter in accordance with one particular embodiment of the present invention.

The present invention relates to electrode plates that reduce high voltage glitch rates in accelerators by improving pumping, in particular, by adding blind vent holes in electrode plates. Note that, for purposes of the present application, the terms "electrode" and "grid assembly" are used interchangeably, herein. Referring now to FIGS. 3 and 4, there is shown one particular embodiment of a portion of an extraction assembly 100 of an ion implantation system including a suppression grid 110 and a ground grid 160, in accordance with one particular invention. The suppression grid 110 includes a base plate 120 which may be made from graphite, stainless steel or other materials.

The suppression base plate 120 includes a central slot 130 configured to receive a suppression electrode aperture 140, which is secured thereto using the appropriate fasteners (not shown). In order to promote venting through the suppression grid 110, the base plate 120 additionally includes a plurality of holes or slots 132 that are configured to receive the body of the blind venting inserts 150 (i.e., wherein a flange is mated with a recess in the rear of the plate 120 and secured to the plate 120 via a fastener, not shown). Note that, if desired, blind venting holes could be made directly into the base plate 120; into a single separate piece; and/or into a separate flange, as shown.

Similarly, in the present preferred embodiment, the ground grid 160 includes a ground plate 170, to which a ground electrode aperture 180 is secured using fasteners (not shown) in the central slot 172. As with the suppression base plate 120, the ground plate 170 includes a plurality of slots 174 (two, in the present example) that are configured to receive the blind venting inserts 190, as described above in connection with the blind venting inserts 150.

The blind venting inserts 150, 190 are configured to add ventilation on the suppression and ground grids 110, 160, thereby improving vacuum levels in the surrounding areas. The blind venting inserts 150, 190 are, preferably, made of graphite, as well. Inserts 150 may be identical to inserts 190, or may be different, as desired. Each of the inserts 150, 190 includes a plurality of venting channels 152, 192, respectively, which do not have any line of sight from the source side of the suppression grid to the analysis side of the ground grid and/or vice versa.

Figure 1:
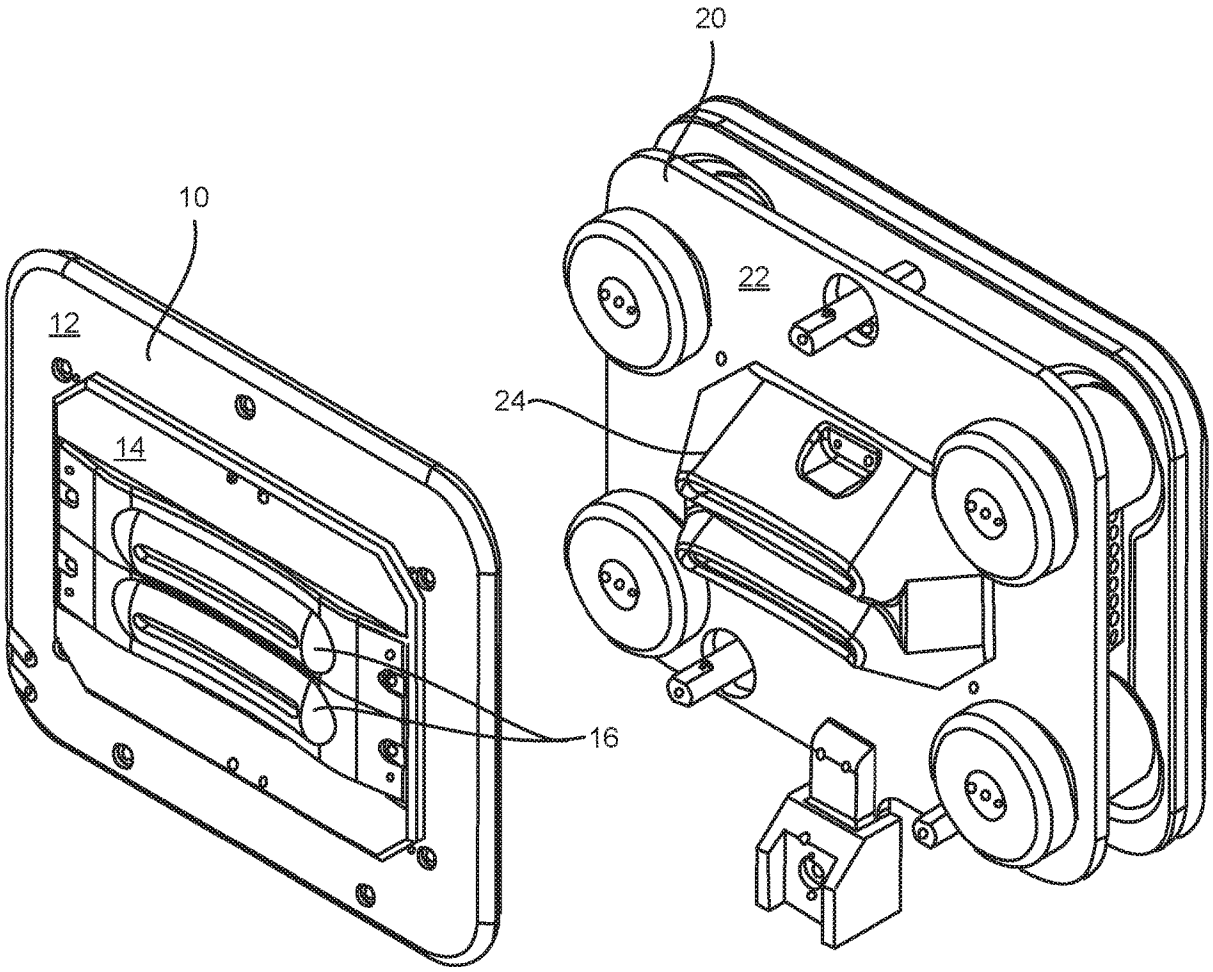
FIG. 1 (Prior Art)
FIG. 1 is a partially exploded, perspective view of the suppression and ground grids of an ion implanter in accordance with the prior art.
Figure 2A:
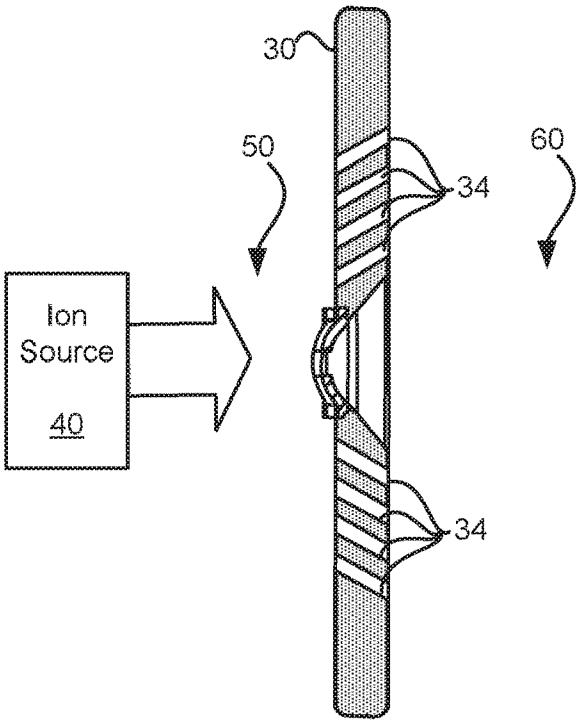
FIG. 2A (Prior Art)
FIG. 2A is a cross-sectional view, taken along the section line A-A, of the prior art vented tungsten extraction grid of FIG. 2.
Figure 2:
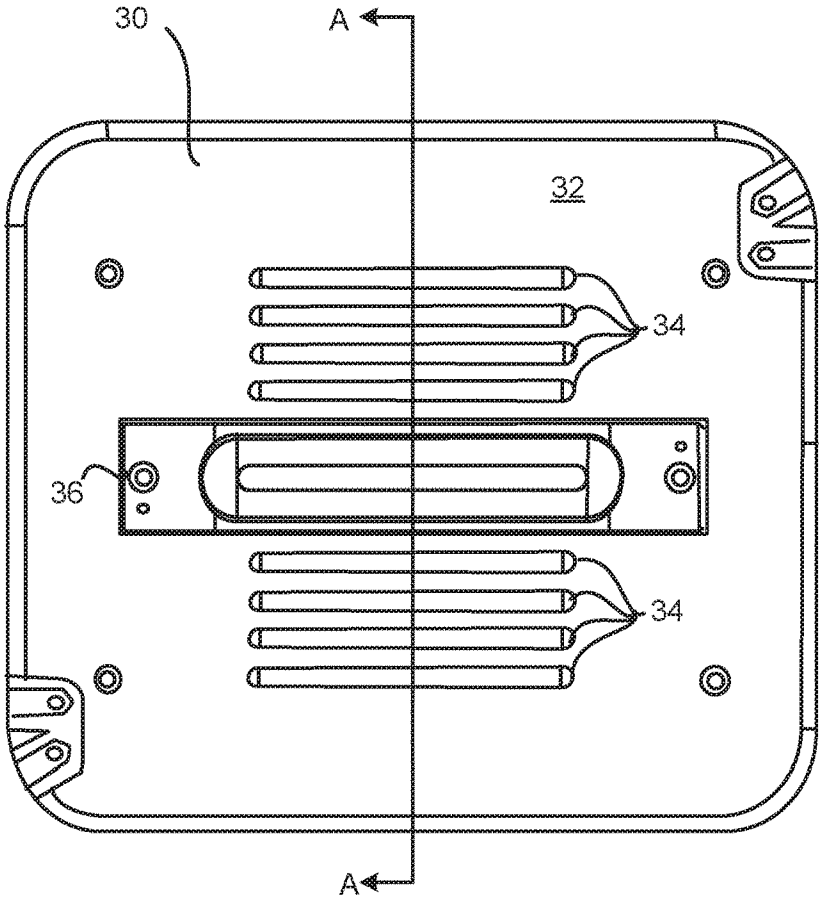
FIG. 2 (Prior Art)
FIG. 2 is a simplified Illustration of a front plan view of a vented tungsten extraction grid in accordance with the prior art.
Figure 5:
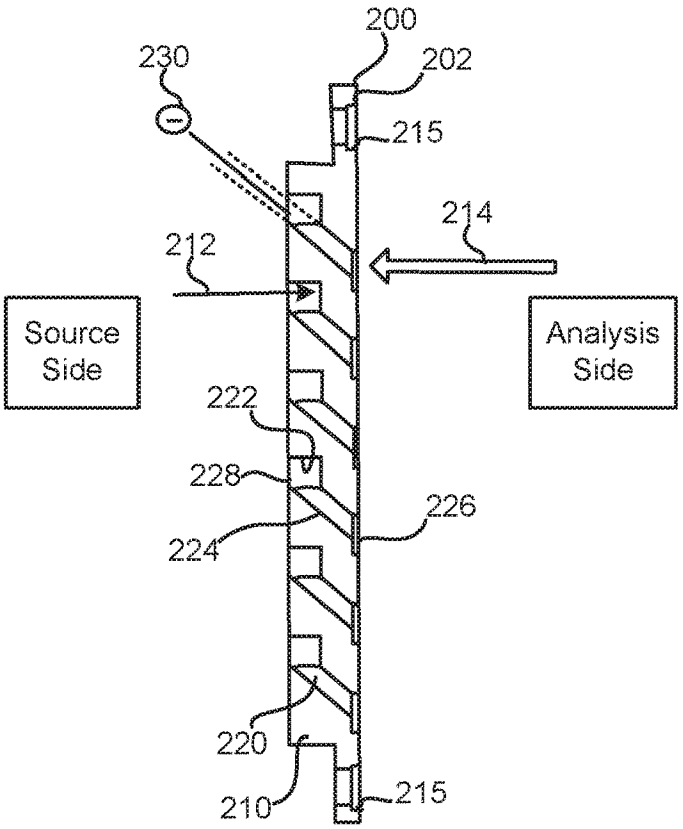
FIG. 5 is a side, cross-sectional view of a single blind-vented insert, according to a first particular embodiment of the invention.

Referring now to FIG. 5, there is shown a side, cross-sectional view of one particular embodiment of a one side blind-vented insert 200, which can be used as the inserts 150 and/or 190 of FIGS. 3 and 4. The blind-vented insert 200 includes a body 210 which may be mounted in a separate flange 202, which includes the fastener holes 215. The body 210 has a plurality of blind-vent holes 220 extending therethrough. In the present preferred embodiment, each blind-vent hole 220 includes a well 222 that extends from a hole or opening 228 in the arc side face of the insert 200, into the body 210, offset from a hole or opening 226 in the face on the ground side of the insert 210. In one particular embodiment of the invention, well 222 is cylindrical in shape, although this is not meant to be limiting. An angled channel 224 extends from the opening 226, into the body 210, where it opens into a sidewall of the well 222. In the present embodiment, extracted positive ions strike the negative suppressor plate. Since their trajectory is nearly orthogonal to the surface, the distribution of secondary particles and photons peaks in that direction. Thus, the base of the well 222 of each channel 224 provides a ground/analysis directional stop for this forward peaked distribution of secondary electrons, and, in this sense, there is no line of sight from the source side to the analysis side. Only secondary photons with sufficient energy to penetrate the body 210 can reach the ground grid.

In contrast, in the present embodiment illustrated in FIG. 5, the opening 226 is aligned with the angled channel 224 to provide a direct line of sight to the opening 228, for secondary electrons generated in the vent channel 224 by incident ions or x-rays from the analysis side of the insert 200 (i.e., arrow 214). Such a line of sight is illustrated by the passage through the body 210 and into the arc side gap of the exemplary electron 230.

Thus, the embodiment illustrated in FIG. 5 includes a one-sided stop, wherein secondary electrons created by ions and low energy x-rays from the arc gap cannot reach the analysis side, but secondary electrons created by ions or x-rays from the analysis gap can reach the arc gap. Thus, in the present context, the one-sided stop in FIG. 5 is said to have no line of sight for secondaries generated on the source side into the ground/analysis gap.

Figure 6A:
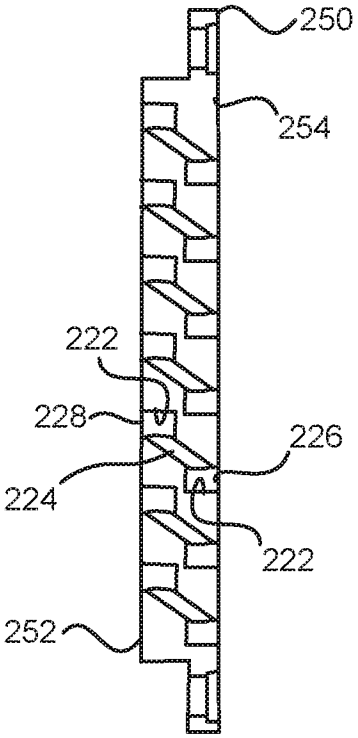
FIG. 6A is a side plan, cross-sectional view of the double blind vented insert of FIG. 6.
Figure 6:
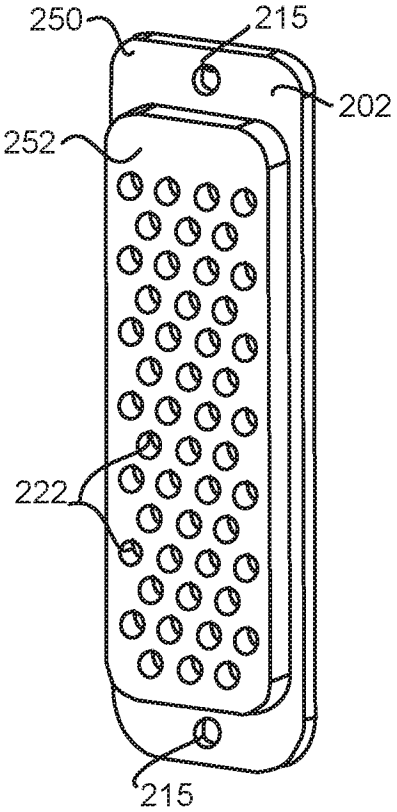
FIG. 6 is a perspective view of a double blind-vented insert, according to another particular embodiment of the invention.

Referring now to FIGS. 6-6A, there is illustrated another preferred embodiment of a blind-vented insert 250 that can be used as the blind-vented inserts 150 and/or 190 in FIGS. 3 and 4. The blind-vented insert 250 is similar in most respects to the blind-vented insert 200 (with like reference numbers representing like parts), with the exception that the insert 250 is double blind, having stops in both directions, which are offset (longitudinally, in the present preferred embodiment) relative to one another. More particularly, a plurality of blind-vented channels 224 extend from the arc face 252 of the insert 250 to the ground face 254 of the insert 250. However, the present embodiment preferentially stops ground direction secondaries generated by ion impact from the source, and source direction secondaries generated by ions from the ground side. In this sense, there is no line of sight from the stops in the first face 252 to the second face 254, and vice versa. Rather, wells 222 act as stops on either side of the insert 250, to prevent secondary electrons created by ions or low energy x-rays from either side of the insert 250 from reaching the other side of the insert 250.

Thus, as illustrated more particularly in FIG. 6A, in the present embodiment, secondary electrons created by ions or low energy photons, depending on the material, from the arc gap side of the blind-vented insert 250 cannot reach the analysis grid and secondary electrons created by ions or low energy photons from the analysis gap cannot reach the plate.

Figure 7B:
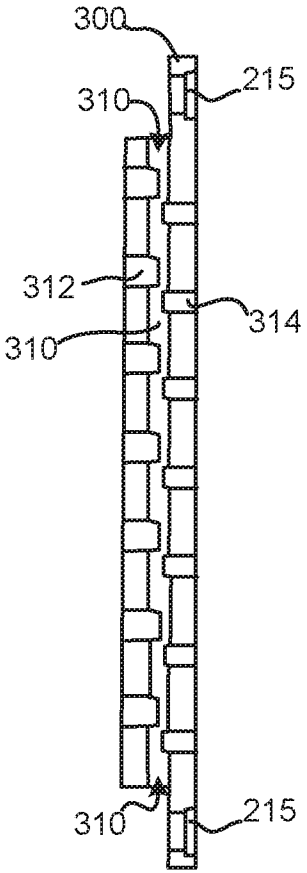
FIG. 7B is a side plan, cross-sectional view of the double blind vented insert of FIG. 7.
Figure 7A:
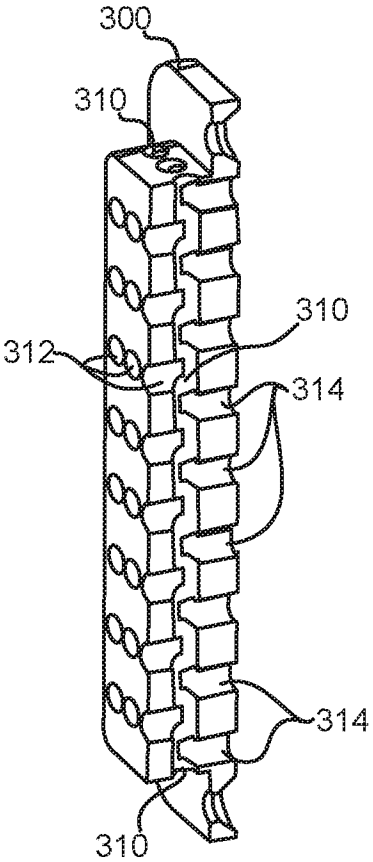
FIG. 7A is a perspective view of a cross-section of the double blind vented insert of FIG. 7.
Figure 7:
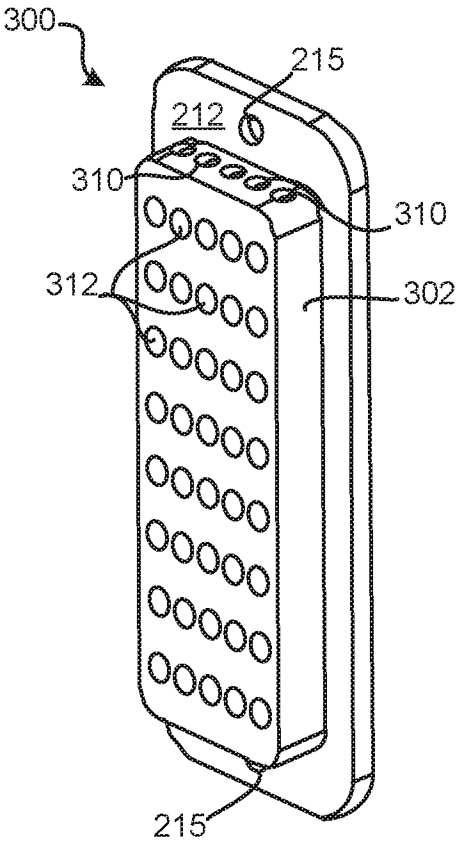
FIG. 7 is a perspective view of a double blind-vented insert, according to a further particular embodiment of the invention.

Referring now to FIGS. 7-7B, there is shown an alternate embodiment of the invention, wherein a blind-vented insert 300 is created using a different mechanical design, wherein a vertical channel 310 is used to interconnect sets of staggered or offset holes 312, 314, instead of an angled channel between the wells, as described in connection with FIGS. 5-6A. More particularly, the vertical channels 310 extend vertically through the body 302 of the insert 300 and intersect with the horizontally aligned, wells or stops 312, 314 extending from each face into, but not through, the body 302 of the insert 300.

For example, in one exemplary embodiment illustrated in FIGS. 7-7B, a horizontal row of five wells 312 extend through the front face and extend partially into the body 302. Correspondingly, five wells 314 extend through the rear face and partially into the body 302. The distal ends of each of the wells 312, 314 open up into one of the vertical channels 310, however, but not in alignment with one another. Rather, the open rear of the well 312 is in fluid communication with the open rear of the well 314 via the channel 310, but is offset therefrom, thus permitting venting from the combination, but not providing a line of sight through the wells and channel 312, 314, 310 through which secondary electrons generated in the wells 312, 314 can travel. This permits gas to be vented, without permitting secondary electrons generated in the wells 312, 314 from crossing over from one well to the other.

In the present embodiment, one vertical channel 310 is provided for each vertical column (i.e., vertically aligned plurality) of wells 312, 314. For example, in the embodiment illustrated in FIG. 7, one channel 310 interconnects each of the five columns of wells 312 with one of the five columns of wells 314, of which only one column can be seen in the figures. Note that this is not meant to limit the invention only thereto, as lesser numbers of columns and/or greater numbers may be used without departing from the scope and spirit of the present invention. The configuration illustrated in FIGS. 7-7B provides for double line of sight stop (i.e., from either side of the blind venting insert) for secondary electrons formed in either the wells 312 or the wells 314 from ions or x-rays impinging thereon. In other words, secondary electrons created by ions or x-rays from the arc gap cannot reach the analysis gap, and secondary electrons created by ions or x-rays from the analysis gap cannot reach the arc gap.

As can be seen from the foregoing exemplary description of the preferred embodiments, the present invention provides a vented electrode that eliminates the line of sight through the vent holes, to stop stray energetic charged particles and some photons from going through the suppressor plate from the extraction gap to the ground plate, and/or from the suppression gap to the source plate. The impact of x-rays or energetic through particles can generate ions that would be accelerated into the suppressor plate, which, in turn, can generate electrons that strike the source or ground electrodes.

Although discussed herein in connection with suppression and ground electrodes, the present invention can be applied to other types of electrodes, including accelerator and plasma electrodes, without departing from the scope or spirit of the present invention.

Note that, although both the suppression grid and ground grid have been illustrated in the preferred embodiment as including blind-venting according to the present invention, it should be understood that it is possible only one of the two could include such venting without departing from the scope and spirit of the present invention. Additionally, instead of being incorporated as inserts into the plates, the plates themselves can be vented, as taught herein, and still be within the scope of the present invention.

It should be understood that this principle can be applied in environments in which particular materials may be preferred for process compatibility. In particular, all or parts of the accelerator grids may be made of preferred conducting materials, such as, Tungsten, graphite, Molybdenum, stainless steel and/or other conducting materials, as desired, without departing from the scope or spirit of the present invention.

While a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

The invention claimed is:

1. A vented electrode, comprising:

a plate including a front face and a rear face;

the plate additionally including a venting portion and at least one aperture; and the venting portion including a plurality of holes in the front face of the plate and a plurality of holes in the rear face of the plate, wherein no direct line of sight exists between the holes of in the front face and the holes in the back face in at least one direction of: from the front of the plate to the back of the plate or from the back of the plate to the front of the plate;

wherein said venting portion is removably connected to said plate.

2. The vented electrode of claim 1, wherein said plate is made from graphite.

3. The vented electrode of claim 1, wherein said plurality of holes in the front face of the plate are offset relative to said plurality of holes in the rear face of the plate, and said venting portion additionally includes a plurality of vertical channels extending through a body of said venting portion, each vertical channel interconnecting connecting a vertical line of holes in the front face of the plate to a vertical line of holes in the back side of the plate without providing a line of sight in at least one direction from the front of the plate to the back of the plate, or from the back of the plate to the front of the plate.

4. The vented electrode of claim 3, wherein said holes are configured as wells extending into a body of said electrode.

5. The vented electrode of claim 1, wherein the vented electrode is a suppression electrode.

6. The vented electrode of claim 1, wherein the vented electrode is a ground electrode.

7. The vented electrode of claim 1, wherein the vented electrode is an extraction electrode.

8. A vented electrode, comprising:

a plate including a front face and a rear face;

the plate additionally including a venting portion and at least one aperture; and the venting portion including a plurality of holes in the front face of the plate and a plurality of holes in the rear face of the plate, wherein no direct line of sight exists between the holes of in the front face and the holes in the back face in at least one direction of: from the front of the plate to the back of the plate or from the back of the plate to the front of the plate;

wherein the venting portion includes at least one blind-venting insert removably fixed to said plate.

9. The vented electrode of claim 8, wherein said at least one blind-venting insert is made from graphite.

10. The vented electrode of claim 8, wherein each hole of said plurality of holes in said front face is connected to one hole of said plurality of holes in said back face by an angled channel.

11. The vented electrode of claim 10, wherein said holes are configured as wells extending into a body of said electrode and said angled channel provides no line of sight in at least one direction from wells in the front of the plate to wells in the back of the plate, or from wells in the back of the plate to wells in the front of the plate.

12. The vented electrode of claim 10, wherein said holes are configured as wells extending into a body of said electrode and said angled channel provides no line of sight from wells in the front of the plate to wells in the back of the plate, and vice versa.

13. A blind-venting insert for an electrode, comprising:

a body configured to mate with a slot in a plate carrying an electrode;

the body including a plurality of holes in the front face of the plate and a plurality of holes in the rear face of the plate, wherein no direct line of sight exists between the holes of in the front face and the holes in the back face in at least one direction of: from the front of the plate to the back of the plate or from the back of the plate to the front of the plate;

wherein said body of the venting portion is configured to be removably connected to the plate.

14. The blind-venting insert of claim 13, wherein the blind-venting insert is made from graphite.

15. The blind-venting insert of claim 13, wherein each hole of said plurality of holes in said front face is connected to one hole of said plurality of holes in said back face by an angled channel.

16. The blind-venting insert of claim 15, wherein said holes are configured as wells extending into a body of said electrode and said angled channel provides no line of sight in at least one direction from wells in the front of the plate to wells in the back of the plate, or from wells in the back of the plate to wells in the front of the plate.

17. The blind-venting insert of claim 15, wherein said holes are configured as wells extending into a body of said electrode and said angled channel provides no line of sight from wells in the front of the plate to wells in the back of the plate, and vice versa.

18. The blind-venting insert of claim 13, wherein said plurality of holes in the front face of the plate are offset relative to said plurality of holes in the rear face of the plate, and said venting portion additionally includes a plurality of vertical channels extending through a body of said venting portion, each vertical channel interconnecting connecting a vertical line of holes in the front face of the plate to a vertical line of holes in the back side of the plate without providing a line of sight in at least one direction from the front of the plate to the back of the plate, or from the back of the plate to the front of the plate.

19. The vented electrode of claim 18, wherein said holes are configured as wells extending into a body of said electrode.

* * * * *